US007217063B2

(12) United States Patent
Moore, Jr. et al.

(10) Patent No.: US 7,217,063 B2
(45) Date of Patent: May 15, 2007

(54) LATCH FOR LEACHING CHAMBER

(75) Inventors: Roy E. Moore, Jr., Killingworth, CT (US); Ronald P. Brochu, Westbrook, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 10/992,917

(22) Filed: Nov. 19, 2004

(65) Prior Publication Data

US 2005/0111915 A1 May 26, 2005

Related U.S. Application Data

(60) Provisional application No. 60/523,553, filed on Nov. 20, 2003.

(51) Int. Cl.
*E02B 11/00* (2006.01)
*E02B 13/00* (2006.01)

(52) U.S. Cl. ..... 405/49; 405/46

(58) Field of Classification Search ..... 405/43–49
See application file for complete search history.

(56) References Cited

U.S. PATENT DOCUMENTS

| | | | | |
|---|---|---|---|---|
| 4,759,661 | A | 7/1988 | Nichols et al. | 405/48 |
| 5,511,903 | A | 4/1996 | Nichols et al. | 405/43 |
| 5,588,778 | A | 12/1996 | Nichols et al. | 405/48 |
| 5,669,733 | A | 9/1997 | Daly et al. | 405/48 |
| 6,375,388 | B1 | 4/2002 | Zoeller et al. | 405/43 |
| 6,592,293 | B1 | 7/2003 | Hedstrom et al. | 405/48 |
| 6,698,975 | B1 * | 3/2004 | Benecke | 405/43 |
| 2003/0219310 | A1 * | 11/2003 | Burnes et al. | 405/39 |
| 2005/0074287 | A1 * | 4/2005 | Brochu et al. | 405/43 |
| 2005/0074288 | A1 * | 4/2005 | Moore, Jr. | 405/46 |

* cited by examiner

*Primary Examiner*—Sunil Singh
(74) *Attorney, Agent, or Firm*—Charles G. Nessler; Steven M. McHugh

(57) ABSTRACT

Two identical arch shape cross section chambers are joined together so that a dome shape part of one end of the chamber is overlapped by the opposing plain end of the second chamber. Thus, one chamber may pivot in the horizontal plane, for adjustment during installation. A latch at the top of the joint between the chamber pair inhibits vertical motion and separation of the overlapping chamber, while permitting horizontal plane pivoting. A latch comprises a tang which cantilevers outwardly from the top of the dome end, to engage a catch which is a flared portion of lip on the overlapping plain end.

18 Claims, 4 Drawing Sheets

LATCH FOR LEACHING CHAMBER

This application claims benefit of provisional patent application Ser. No. 60/523,553, filed Nov. 20, 2003.

TECHNICAL FIELD

The present invention relates to arch shape cross section plastic chambers, which when buried are used for receiving and dispersing wastewater or stormwater.

BACKGROUND

Arch shape cross section plastic chambers have been widely used for receiving and dispersing waters when buried in soil or other media. Examples of such chambers are shown in U.S. Pat. Nos. 4,759,661 and 5,511,903 to Nichols. Typically, chambers are about 4–8 feet in length. They have mating opposing ends, so that like chambers may be connected end to end at joints where there is overlap of one chamber by the adjacent chamber. The joint fit is sufficient to prevent entry of soil and other media. Preferably, the chambers latch together in some positive way, so the overlap fit is not lost, by vertical motion of one chamber relative to the other. See U.S. Pat. No. 5,336,017 to Nichols for an example of chamber joints.

However, sometimes the nature of the terrain for a desired installation requires that chambers be installed as non-straight rows. In such situations, a bend in a string of chambers can be accomplished by use of chambers or adapters which have angled ends. See U.S. Pat. No. 5,588,778 to Nichols et al. and U.S. Pat. No. 5,669,733 to Daly et al. More preferably, chambers may be constructed with ends that enable the installer to make one chamber overlay the next, with the long axes running at chosen angle, within some range, for example plus or minus 10 degrees. Sometimes, such types of chambers are referred to as swivel-end chambers. Examples of such chambers, which are sometimes referred to as swivel-end chambers, are shown in U.S. Pat. No. 6,592,293 to Hedstrom et al., U.S. Pat. No. 6,375,388 to Zoeller et al., and U.S. patent application Ser. No. 10/442,810 of Burnes et al.

However, one of the problems attending the previously known so-called swivel end chambers is that there can be a tendency for one chamber to lift off from the other, before the chamber string is backfilled. That can undesirably allow media to enter the chamber string through the resultant gap, which can lead to problems with ingress of material over time during use. Such an adverse condition may be avoided by careful installation, or by the use of mechanical screw fasteners of the like, to attach one chamber to the other once the chambers are laid in place at the desired angle. However, installers may often not take adequate care. They may be annoyed by the nuisance and increased labor which attend the use of mechanical fasteners. Fasteners may not be timely installed, before material gets into the joint. Slight adjustment after fastening is not possible unless the fasteners are removed. Thus there is need for improvements in chambers to overcome the nuisance problem.

SUMMARY

An object of the invention is to provide means for preventing relative vertical motion at the joint between swivel-end chambers. In achieving such object, one or more other objects should be attained. The means has to accommodate any of the different angles of connection which may be possible and desired, allow the use of end caps, be suited for economic manufacturing, be durable during handling, and be easy to install in the field.

In accord with the invention the two like arch shape cross section chambers are joined together so that one chamber may pivot in the horizontal plane, for adjustment during installation, and a latch inhibits vertical motion, or separation, of the chambers. Each chamber has a dome end which can be over-lapped by the opposing plain end, so like chambers may mate to form a joint. The latch is at the top of the chamber, to prevent upward motion of the overlapping chamber while permitting horizontal plane rotation which adjusts the angle between two chambers Preferably, the latch comprises a tang which cantilevers outwardly from the top of the dome end, so a portion of the plain end of the overlapping chamber underlies it, to form a catch portion of the latch. In one embodiment, the catch is a portion of a lip which runs along the arch shape curve plain end of the chamber; more preferably, the catch is an outwardly flared portion of the lip, having in the horizontal plane an arc curve with a radius running from the point of pivoting. Preferably, the two mated chambers are engaged with a pin connection which comprises mating male and female parts of molded plastic chambers.

The invention inhibits inadvertent vertical motion of the overlapping chamber by the installer, prior to backfilling the trench with soil or other media. The good fit of the joint is maintained. The invention is simple and economic to manufacture.

The foregoing and other objects, features and advantages of the present invention will become more apparent from the following description of preferred embodiments and accompanying drawings.

DESCRIPTION

The present invention, which is described in provisional patent application Ser. No. 60/523,553 filed Nov. 20, 2003, is particularly to useful with the leaching chambers described in pending U.S. patent application Ser. No. 10/677,938 to Brochu et al. and pending U.S. application Ser. No. 10/442,810 of Burnes et al., both filed Oct. 1, 2003. The drawings and text of both applications are hereby incorporated by reference. A preferred embodiment of the patent-pending leaching chambers is sold commercially as Quick4™ Chamber by Infiltrator Systems Inc., Old Saybrook, Conn. 06475, U.S. An example of the invention is described below in terms of such Quick4 chamber. The exemplary chamber of the present invention may be made of injection molded high density polyethylene or polypropylene thermoplastic materials or substitutional materials, using well known techniques of the prior art. See U.S. Pat. No. 5,401,459 to Nichols et al. Some less preferred embodiments of the invention may be made by other plastic forming methods and or of other materials.

Figure 1:
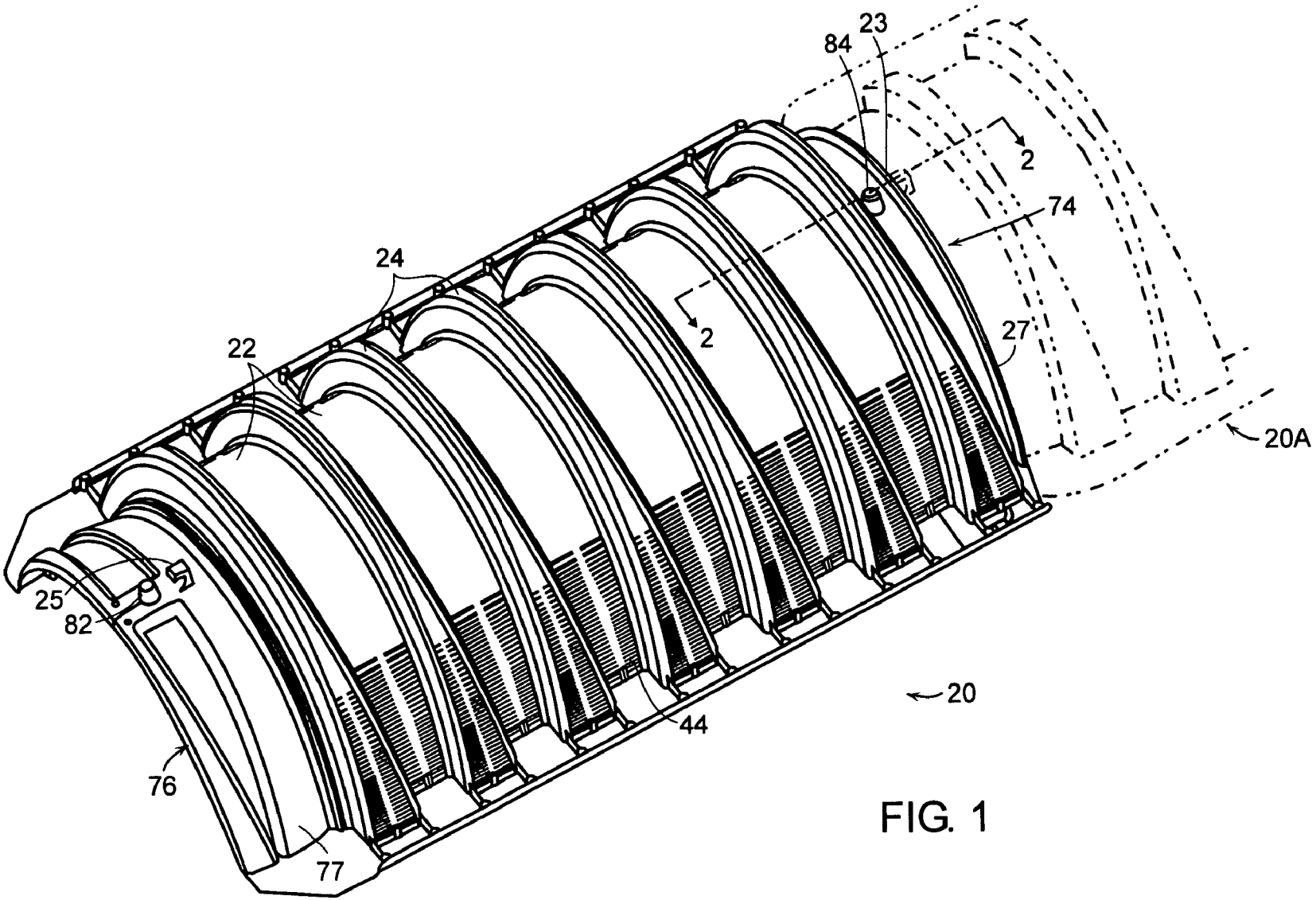
FIG. 1 shows is an isometric view of a leaching chamber, with a portion of a like chamber shown in phantom.
Figure 2:
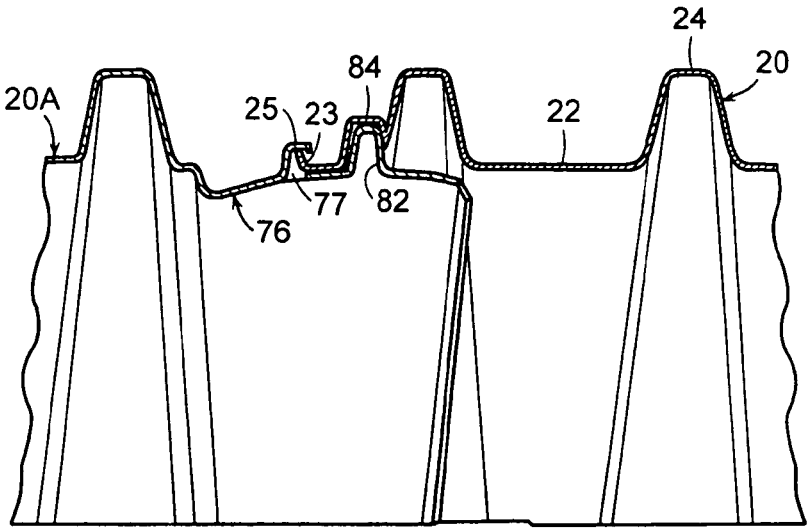
FIG. 2 is a vertical lengthwise center plane cross section through the joint of two chambers.

In FIG. 1 chamber 20 is shown joined to a like chamber 20A, shown in phantom. It has the features of the aforementioned Brochu et al. chamber. FIG. 2 is a vertical centerline cross section through the joint between the two chambers 20, 20A. (In FIG. 2, chamber 20A is no longer shown in phantom, and it is on the left, compared to being on the right in FIG. 1.) Chamber 20 has an arch shape cross section and corrugations comprised of alternating peaks 24 and valleys 22. The chamber is about 48 inches long, about 30 inches wide, and about 12 inches high. The opposing sidewalls 44 have a multiplicity of slots for leaching of water into the soil.

The two chambers 20, 20A typically will be part of a larger string of chambers which are typically, but not necessarily, identical to chamber 20. The first end 74 of typical first chamber 20 overlaps the opposing second end 76 of a like chamber, e.g., chamber 20A. Second end 76 has a surface of revolution portion 77, called a dome (segment) hereafter. The first end does not have an interior surface of revolution, and thus is referred to here as the plain end, in distinction to the dome end. The design is such that the arch shape interior of the plain end fits the dome. In other chamber embodiments, the plain end may have an interior surface of revolution or other special contour features. The dome 77 enables pivoting of one chamber relative to another about a vertical axis which runs through pin connection 82, 84, typically within plus or minus 10–15 degrees. The overlapping end 74 has a hollow molded female-function pin 84, the interior of which fits over a smaller like male-function pin 82 at the overlapped end 76. The exterior of dome 77 fit with the interior features of the end 74 of the overlapping chamber is sufficiently tight to prevent adverse ingress of surrounding soil and the like, when the chambers are backfilled and used, regardless of the horizontal plane angle between the chambers.

Figure 3:
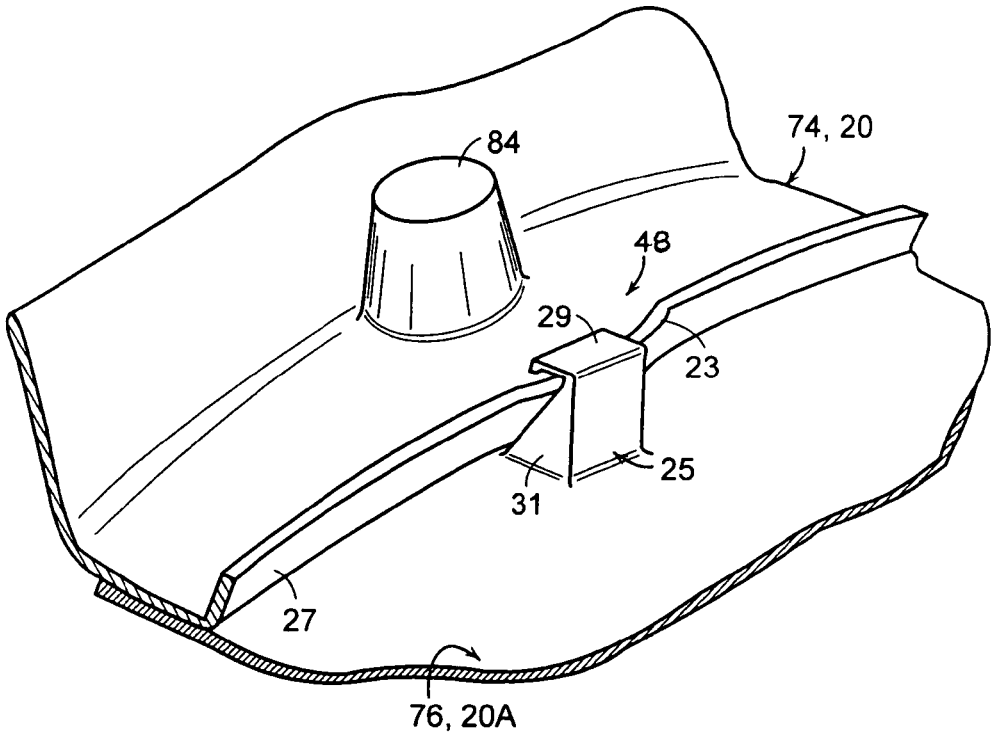
FIG. 3 is an isometric fragment, showing details of the joint between two chambers and how they are latched together.
Figure 4:
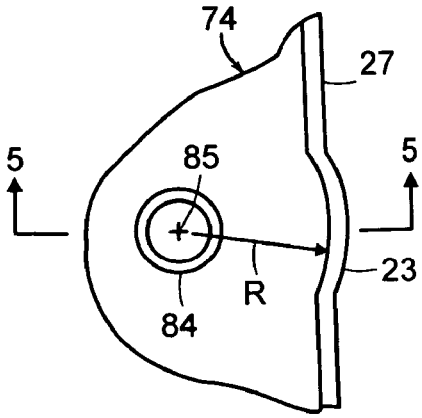
FIG. 4 is a vertical down view of a fragment of the end of the chamber which comprises female pin and the catch, which is one part of the latch.

FIG. 3 is a fragmentary view, looking onto the overlap joint between the two chambers 20, 20A. With reference to all FIGS. 1–3, a latch 48 at the top of the chamber is comprised of two parts: pawl 25 on the overlapped end 76 of the chamber, and catch 23 on the overlapping end 76 of chamber 20A. Catch 23 is an outwardly flared portion of lip 27, at the top of the chamber end 74, which lip 27 runs along the arch shape opening at the end of the chamber, to enhance rigidity of the end. With reference to FIG. 4, which is a view looking down on end 74, and to related FIG. 5, in the horizontal plane catch 23 preferably has an arc shape of radius R, which runs from pin 84, or the axis of rotation of the end, in absence of a pin. See FIG. 5 with respect to how catch 23 gracefully transitions to the lip 27. In the generality of the invention, catch 23 may be an isolated portion at the peak of the chamber end, and there may be no lip 27 running along the end; and the edge of the local portion of the end which functions as the catch may have a radius R, as described, so there is essential constancy of distance between the latch and pawl within the design angle of rotation.

When two chambers are mated, as shown, tang 29 of pawl 25 overlaps catch 23, to thereby form latch 40, and to thereby inhibit vertical separation of the chambers at the pivotable joint. The nature of the latch permits horizontal plane pivotable adjustment of the overlapping chamber, which is convenient for having chambers run just where desired, within trenches.

Figure 5:
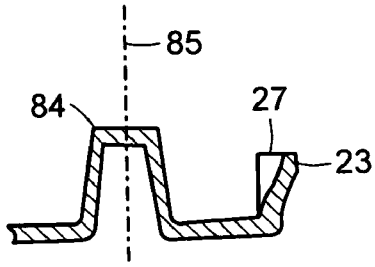
FIG. 5 is a cross section view of the structure shown in FIG. 4.

With reference again to FIG. 1-3, pawl 25 has a cantilever tang 29, projecting horizontally from pawl body 31. Preferred pawl body 31 has triangular sides and a U-shape cross section in the horizontal plane. The vertical side of the body, that is the edges of the U-opening which faces the joint and mating chamber, inclines away from such, to accommodate the outward flare or tilt of catch 23, as shown in FIG. 4-5. The pawl and catch configurations shown are suitably strong, and may be formed without additional slides or complication, in an injection core and cavity mold which is adapted to make the essential chamber.

When the chambers are connected to make a pivotable joint connection, as described, longitudinal motion of overlapping chamber 74 to and away from the pawl 25 is prevented by engagement of pins 82, 84. When chambers are so-engaged, chamber 20A can be rotated about the pin connection relative to chamber 20B, since catch 23 slides under tang 29, and owing to the arc curve of the catch, the catch and pawl parts stay in approximately the same proximity. Mold design considerations lead to an opening 77 beneath the pawl at the top of the dome end. See FIG. 2; also FIG. 6 discussed below. The details of the plain end, in particular the flared lip portion which comprises the preferred catch, blocks entry of soil in vicinity of the latch.

The latch design does not create difficulty in joining two chambers. To make a joint, a first chamber is laid on the ground. Then a second chamber is tilted upwardly and its lower end 74 is overlapped on the dome end of the first chamber, and slipped under the tang of the pawl of the first chamber. The second chamber is then rotated downwardly toward horizontal. Given the placement and conical taper shape of pins 82, 84, the male pin slips within the cavity of the female pin. And, as shown in FIG. 2, the female pin 84 is preferably positioned on the chamber so its lower edge intersects the web of adjacent peak corrugation. Thus, the lower side of the cone of the pin, which faces the interior of the chamber, is missing. While the configuration does not adversely affect pin function, in preventing chamber separation, the omitted cone portion facilities entry of the female pin into the male pin when the chambers are joined as described. Other configurations of pinning can be used, including a pin which is a separate element inserted into holes in the mated chambers.

Figure 6:
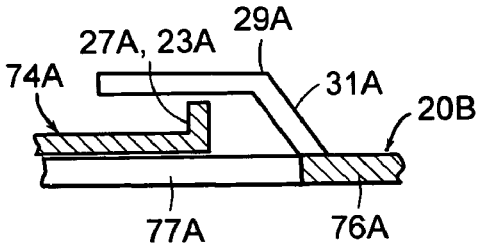
FIG. 6 is a cross section showing an alternate embodiment latch.
Figure 7:
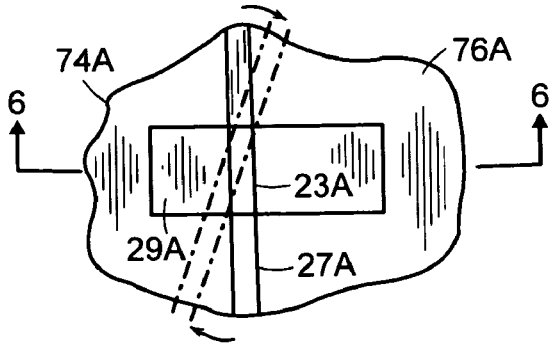
FIG. 7 is a top view of the alternate embodiment latch of FIG. 6.

Preferably, the tip of tang 29 has a slight down-slope, about equal to the tang thickness. See FIG. 3. Such outer tip downward incline is not necessary for the primary function of preventing vertical disengagement. But the tip incline can provide some resistance to chamber longitudinal disengagement, which is additive and little needed when there is pinning as shown in this embodiment. Analogously, motion of the overlapping chamber toward the pawl body will be limited by contact of the lip or chamber end with the body, in the absence of pinning. The body 31 of the pawl may have other shapes than shown. For instance, less preferably, the body may comprise bent up tab 3 IA, as shown in FIG. 6. (Numbers with suffices denote elements which correspond with prior elements.) Reinforcing ribs may be added to tab 31A. As may be implied from the foregoing, in the generality of the invention there may be no pin connections. Other means, or less preferably no means, to prevent lateral disengagement may be used. An example of one other non-pin means is shown in FIG. 7 of aforementioned application Ser. No. 10/442,810.

Figure 8:
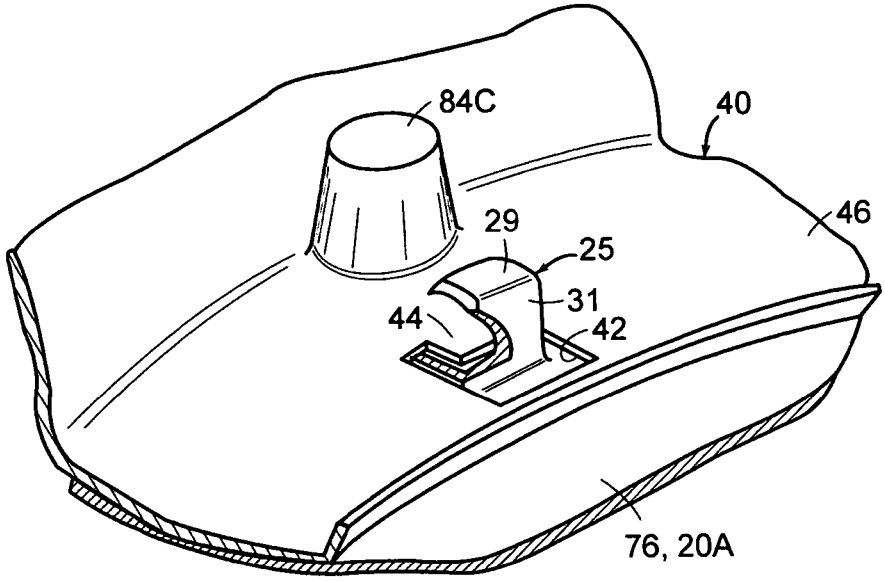
FIG. 8 is a view of the same kind as FIG. 3, showing how an end cap engages the pawl part of the latch.
Figure 9:
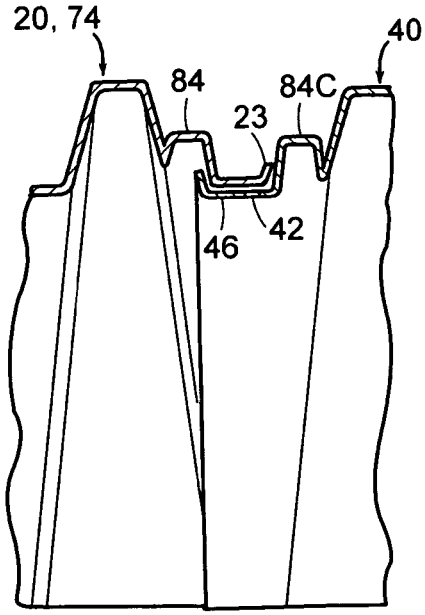
FIG. 9 is a view like FIG. 2, showing how an end cap is overlapped by the plain end of a chamber.

An end cap, for closing the dome end of a chamber by overlapping the dome end, may have a pin connection as described, to prevent horizontal plane separation. An end cap suitable for the exemplary chamber is described in U.S. patent application Ser. No. 10/677,771 of Burnes et al. The end cap may be used to under lap the plain end of an exemplary chamber, or overlap the dome end. FIG. 8, which is analogous to FIG. 3, shows the flange 46 of end cap 40 overlapping dome end 76 of chamber 20A. The end cap has a U-shape slot 42, the axial length of which is somewhat longer than the lengthwise dimension of the pawl. The peninsular shape portion within the U is tongue 44. To engage the end cap with the dome end, the end cap is canted so the flange 46 contacts the top of the dome. As the cap is rotated downwardly, the pawl passes through the bottom part of the U. The cap is then slid toward the chamber so tongue 44 fits within the opening 77 (shown in FIG. 2 and 6) which lies beneath the tang 29 and body 31, to block entry of soil. FIG. 8 shows the top of a cap, in place. In a variation, the bottom of the U is narrower, and the tongue bends elastically upward, to then spring back into its final place, as the cap is installed. Molded female pin 84C receives the pin 82 of the chamber. If there were no pins, the cap would be held in length-wise place by contact of the edge of the U-bottom of slot 42 with the back side of the pawl. It is desirable to have only one end cap, which can seal either end. When the U-shape slot is the means for cap-to-chamber engagement this goal is achieved. The flange of the end cap is able to slip under the plain end of the chamber, as illustrated in the vertical cross section of FIG. 9. If it is acceptable to have two different end cap configurations in the product line, an end cap for the dome end could alternatively have some or all of the same features of the plain end of the chamber 20.

The cross section view of FIG. 6 and the top view of FIG. 7 show another embodiment of chamber with latch. The outer lip 27A of the end 74A of the chamber does not have the arc shape region which characterizes catch 23, described above. The portion 23A at un-flared lip at the top of the chamber functions as catch. In the FIG. 6-7 embodiment, when the chamber having end 74A is rotated relative to chamber 20B, as illustrated by the arrows and phantom view of lip 27A in FIG. 6, the chamber end and associated lip move to an angled position under the tang 29A, which has a length or projection sufficient for the purpose. Thus, there is change in the relative proximity of the catch and pawl when the overlapping chamber is pivoted, compared to the preferred embodiment of FIG. 1-5. In a further variation, lip 27A may be omitted, and the local portion of the plain ordinary end of the chamber top will function as catch.

While the invention has been described in terms of the Quick4 leaching chamber, it will be useful with other configurations of molded plastic chambers used for leaching wastewater, including those described in the Background, with chambers which are not corrugated, and with chambers used for other purposes, including receiving stormwater. The term dome end should be construed loosely and shall comprehend the end of any chamber which has portions which are shaped to receive and allow pivotable rotational adjustment of an overlapping chamber end, while forming a joint which provide a barrier to entry of surrounding soil or media. In the embodiments described above, the ends of the chambers which mate to form the joint and which have the latch parts may be characterized as valleys, being smaller than the adjacent peaks. It will be appreciated that other embodiments, the invention may be applied to chambers which have overlapping ends which are peaks, i.e., ends which are larger than the adjacent (valley) corrugations.

Although this invention has been shown and described with respect to a preferred embodiment, it will be understood by those skilled in this art that various changes in form and detail thereof may be made without departing from the spirit and scope of the claimed invention.

We claim:

1. An improvement in an arch shape cross section chamber, for receiving and dispersing water beneath the surface of the earth, wherein the chamber includes a first end comprising a dome and an opposing second end shaped to overlap and connect with the first end of an identical chamber, and wherein connection of the chamber to an identical chambers forms a joint which enables the chamber and the identical chamber to pivot in a horizontal plane about the dome, the improvement comprising:

a pawl disposed at a top portion of the first end;

a catch disposed at a top edge of the second end, wherein said pawl and said catch are shaped for mutual engagement to form a latch when the chamber is joined to a like chamber, wherein said catch slides laterally beneath said pawl during pivoting of the chamber relative to the identical chamber.

2. The chamber of claim 1, wherein said pawl comprises a body and a tang cantilevered from said body.

3. The chamber of claim 2, wherein said top portion of said first end has an opening beneath said tang and wherein said catch is shaped to cover said opening at any angle of pivoting between said chambers.

4. The chamber of claim 1, wherein said second end has an arch shape opening, further comprising: a lip running along said arch shape opening, wherein said catch is a portion of said lip.

5. The chamber of claim 4, wherein said portion of said lip includes a flared portion.

6. The chamber of claim 5, wherein each of said first end and said second end have a pin connection point about which said chambers pivot and, wherein said flared portion includes an arc shape having a radius centered on said pin connection point of said second end.

7. The chamber of claim 1, wherein each of said first end and said second end have a pin connection point about which said the chamber and the identical chamber pivot in said horizontal plane.

8. The chamber of claim 7, wherein said first end has a male pin connection point and wherein said second end has a female pin connection point.

9. The chamber of claim 1, wherein said pawl includes a tang having a tip portion, wherein said tip portion is downwardly inclined.

10. An assembly comprising:

a pair of substantially identical arch shape cross section chambers for burial within soil or other media, wherein said chambers are mated together at a joint to be pivotable in the horizontal plane relative to each other wherein each chamber includes a dome end and an opposing plain end and wherein said joint is formed by overlapping said plain end of one of said chambers onto said dome end of the other of said chambers; and a latch disposed in the vicinity of a top portion of said joint for inhibiting vertical separation of said chambers, wherein said latch is comprised of a mutually engaged pawl and catch combination, wherein when one of said chambers is pivoted about said joint relative to the other of said chambers, said catch slides beneath said pawl.

11. The assembly of claim 10, wherein each of said chambers further comprises: means for pin connection of one of said chambers to the other of said chambers, about which pivoting takes place.

12. The assembly of claim 10, wherein said pawl comprises a body and a tang cantilevered from said body, lengthwise along said chamber and wherein said plain end has a lip, and wherein said catch comprises a portion of said lip which underlies said tang.

13. The chamber assembly of claim 12, wherein said portion of said lip includes a flared portion having an arc curve with a radius running from the location of a pin connection on said chamber.

14. The assembly of claim 13, wherein said chambers pivot through an arc of at least plus or minus ten degrees.

15. An assembly comprising:

a pair of substantially identical arch shape cross section chambers for burial within soil or other media, wherein said chambers are mated together at a joint to be pivotable in the horizontal plane relative to each other wherein each of said chambers includes a dome end, an opposing plain end, a lip portion at the top of said plain end, a pawl at the top of said dome end, a catch at the top of said plain end and means for pivotable pin connection between one of said chambers to the other of said chambers, wherein said joint is formed by overlapping said plain end of one of said chambers onto said dome end of the other of said chambers so that said pivotable pin connection on one of said chambers is engaged with said pivotable pin connection on the other of said chambers and wherein said pawl and said catch are mutually engaged to form a latch which inhibits vertical separation of said chambers, and wherein said catch slides laterally along said pawl when one of said chambers is pivoted relative to the other of said chambers.

16. The assembly of claim 15, wherein said chambers pivot through an arc of at least plus or minus ten degrees.

17. An assembly comprising:

a pair of substantially identical arch shape cross section chambers for burial within soil or other media, said chambers being mated together at a joint to be pivotable in the horizontal plane relative to each other, wherein each of said chambers include a dome end having a pin connection and an opposing plain end having a lip and said pin connection and wherein said joint is formed by overlapping said plain end of one of said chambers onto said dome end of the other of said chambers;

a latch, disposed in the vicinity of a top portion of said joint between said chambers, for inhibiting vertical separation of said chambers, wherein said latch comprises a mutually engaged pawl and catch combination, wherein said catch slides beneath said pawl when one of said chamber is pivoted relative to the other of said chamber about said joint, wherein said pawl comprises a body and a tang cantilevered from said body, lengthwise along said chamber, and wherein said catch comprises a portion of said lip which underlies said tang, said portion of said lip having a flared portion with an arc curve having a radius running from the location of said pin connection on said chamber, wherein said chambers pivot through an arc of at least plus or minus ten degrees.

18. An assembly comprising:

a pair of substantially identical arch shape cross section chambers for burial within soil or other media, said chambers being mated together at a joint to be pivotable in the horizontal plane relative to each other, wherein each of said chambers includes, a dome end, an opposing plain end, a lip portion disposed at a top portion of said plain end, a pawl end at a top portion of said dome end, and a means for pivotable pin connection of one of said chambers to the other of said chambers, wherein said joint is formed by overlapping said plain end of one of said chambers onto said dome end of the other of said chambers so that said pivotable pin connection of one of said chamber is engaged with said pivotable pin connection of the other of said chambers; and wherein said pawl end and said catch end arc mutually engaged to form a latch which inhibits vertical separation of said chambers and wherein said catch end slides laterally under said pawl end when one of said chambers is pivoted relative to the other of said chambers, said chambers being pivotable through an arc of at least plus or minus ten degrees.

* * * * *